US006584767B1

(12) United States Patent
Koenig

(10) Patent No.: US 6,584,767 B1
(45) Date of Patent: Jul. 1, 2003

(54) EXHAUST DIVERTER

(76) Inventor: Steve Koenig, P.O. Box 307, Fairfax, SD (US) 57335

( * ) Notice: Subject to any disclaimer, the term of this patent is extended or adjusted under 35 U.S.C. 154(b) by 0 days.

(21) Appl. No.: 10/014,182

(22) Filed: Nov. 9, 2001

(51) Int. Cl.[7] ..... F01N 3/00

(52) U.S. Cl. ..... 60/288; 60/324; 137/595; 137/869

(58) Field of Search ..... 60/288, 323, 324; 181/238, 240; 137/595, 869, 887

(56) References Cited

U.S. PATENT DOCUMENTS

| | | | | | |
|---|---|---|---|---|---|
| 2,833,479 | A | * | 5/1958 | Novesky | 60/288 |
| 2,960,178 | A | * | 11/1960 | Lorean | 60/288 |
| 3,751,917 | A | * | 8/1973 | Garcea | 60/288 |
| 3,908,366 | A | * | 9/1975 | Masaki | 60/288 |
| 4,715,472 | A | | 12/1987 | McKee | |
| 4,803,838 | A | * | 2/1989 | Kaeser | 60/288 |
| 4,910,960 | A | | 3/1990 | Ueki et al. | |
| 4,913,260 | A | | 4/1990 | Fallon | |
| 5,427,141 | A | * | 6/1995 | Ohtsubo | 137/595 |
| 5,428,957 | A | | 7/1995 | Keates | |
| 5,452,578 | A | | 9/1995 | Barber | |
| 5,632,304 | A | * | 5/1997 | Kempka et al. | 137/595 |
| 5,743,088 | A | | 4/1998 | Grath | |
| 5,775,100 | A | * | 7/1998 | Sloss et al. | 60/323 |
| 6,263,917 | B1 | * | 7/2001 | Evans | 137/887 |
| 6,286,307 | B1 | | 9/2001 | Feeny et al. | |
| 2001/0009096 | A1 | | 7/2001 | Eguchi et al. | |

FOREIGN PATENT DOCUMENTS

| | | | |
|---|---|---|---|
| JP | 4-203209 | * | 7/1992 |
| JP | 8-189340 | * | 7/1996 |

* cited by examiner

*Primary Examiner*—Thomas Denion
*Assistant Examiner*—Tu M. Nguyen
(74) *Attorney, Agent, or Firm*—Kaardal & Leonard LLP

(57) ABSTRACT

An exhaust diverter for selectively attenuating exhaust volume includes a first pipe for fluidly coupling to and positioning between the engine and the muffler. A second pipe has a first end and a second end. The first end of the second pipe is fluidly coupled to the first pipe. An exhaust pipe is fluidly coupled to the second end of the second pipe. A valve system selectively opens and closes passages through the first and second pipes. The valve system includes a first valve positioned in the first pipe and a second valve positioned in the second pipe. An actuator is mechanically coupled to the valves for selectively opening and closing the first and second valves such that one of the valves simultaneously opens when the other of the valves closes.

18 Claims, 5 Drawing Sheets

EXHAUST DIVERTER

BACKGROUND OF THE INVENTION

1. Field of the Invention

The present invention relates to exhaust cutout devices and more particularly pertains to a new exhaust diverter for selectively attenuating exhaust volume.

2. Description of the Prior Art

The use of exhaust cutout devices is known in the prior art. U.S. Pat. No. 5,524,578 describes a device, which includes a housing for attaching to the collector pipe, and is adapted for releasing the exhaust gases from the collector pipe directly into the atmosphere. Another type of exhaust cutout device is U.S. Pat. No. 5,428,957, which allows the blockage of exhaust flow through the one of the exhaust stacks of a semi-truck for maintenance on that stack.

While these devices fulfill their respective, particular objectives and requirements, the need remains for a device that allows a person to divert exhaust gasses around a muffler and allows this function to be performed from within a vehicle.

SUMMARY OF THE INVENTION

The present invention meets the needs presented above by including a first pipe and a second pipe each having a valve therein. The first pipe performs the function of a traditional exhaust pipe coupling the engines exhaust to a muffler. The second pipe includes an exhaust pipe for diverting exhaust gases to the back of the vehicle such that exhaust gases are not unintentionally diverted to an interior of a vehicle by air-intakes.

Still yet another object of the present invention is to provide a new exhaust diverter that allows constant gas-flow from the engine to the exhaust pipes by using two valves that simultaneously open and close.

Even still another object of the present invention is to provide a new exhaust diverter that includes a control which may be mounted on a dashboard within a vehicle so that the user may control the device from within their car.

Yet another object of the present invention is to provide a new exhaust diverter allows a user to selectively increase horsepower and torque by diverting exhaust around the muffler and by lowering audible sounds of the vehicle by diverting exhaust through the muffler.

To this end, the present invention generally comprises a first pipe having a first end and a second end. Each of the first and second ends has an edge defines an opening. A second pipe has a first end and a second end. The first end of the second pipe is fluidly coupled to the first pipe. The second end of the second pipe has an edge defining an opening. A mounting means mounts the first end of the first pipe to an exhaust outlet and mounts the second end of the first pipe of to the muffler. An exhaust pipe is fluidly coupled to the second end of the second pipe by the mounting means. A valve system selectively opens and closes passages through the first and second pipes. The valve system includes a first valve positioned in the first pipe and a second valve positioned in the second pipe. An actuator is mechanically coupled to the valves for selectively opening and closing the first and second valves such that one of the valves simultaneously opens when the other of the valves closes. A control is electrically coupled to the actuator for remotely selecting rotation of the rod in the first or second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
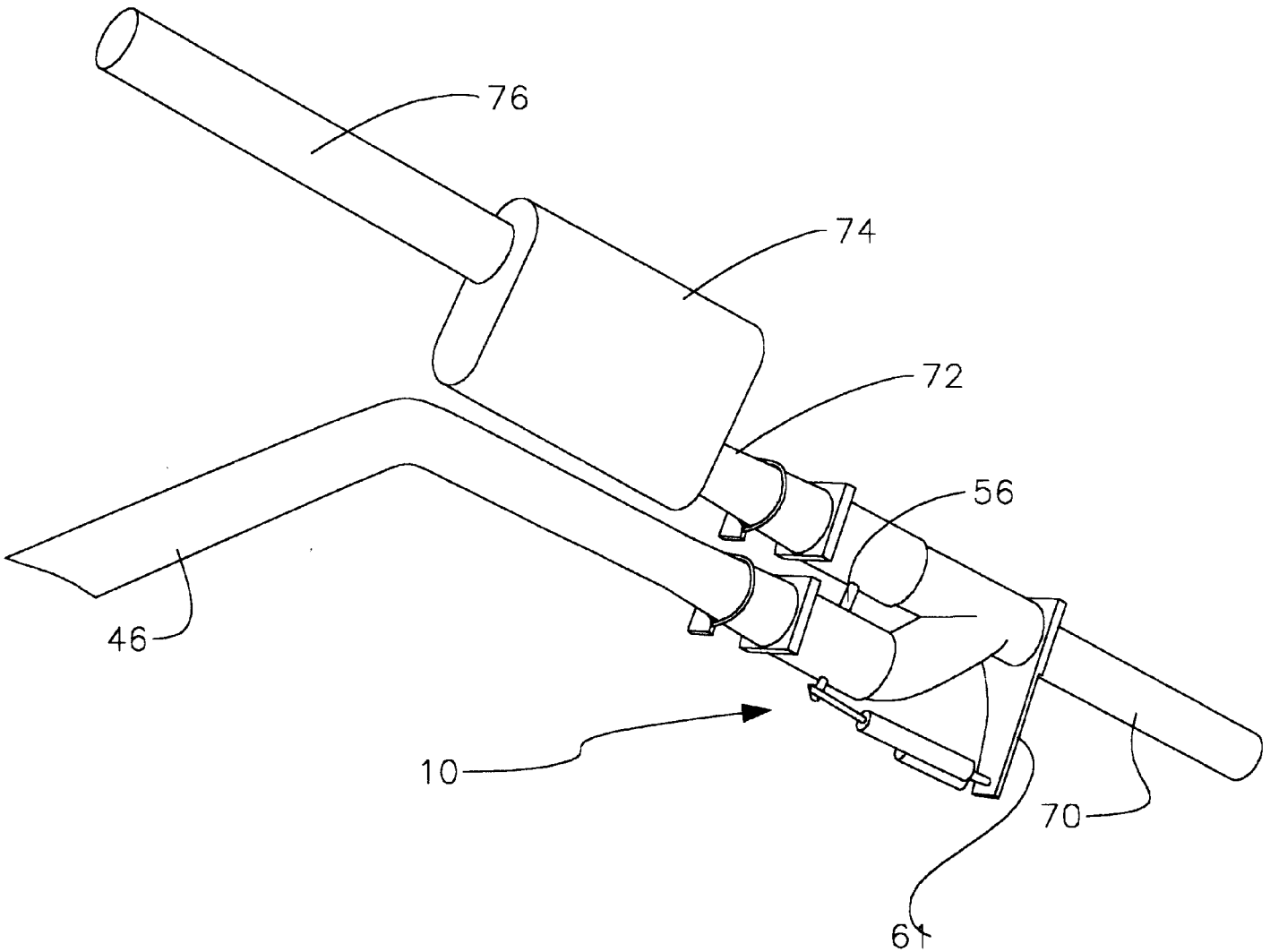
FIG. 1 is a schematic perspective view of a new exhaust diverter according to the present invention.
Figure 2:
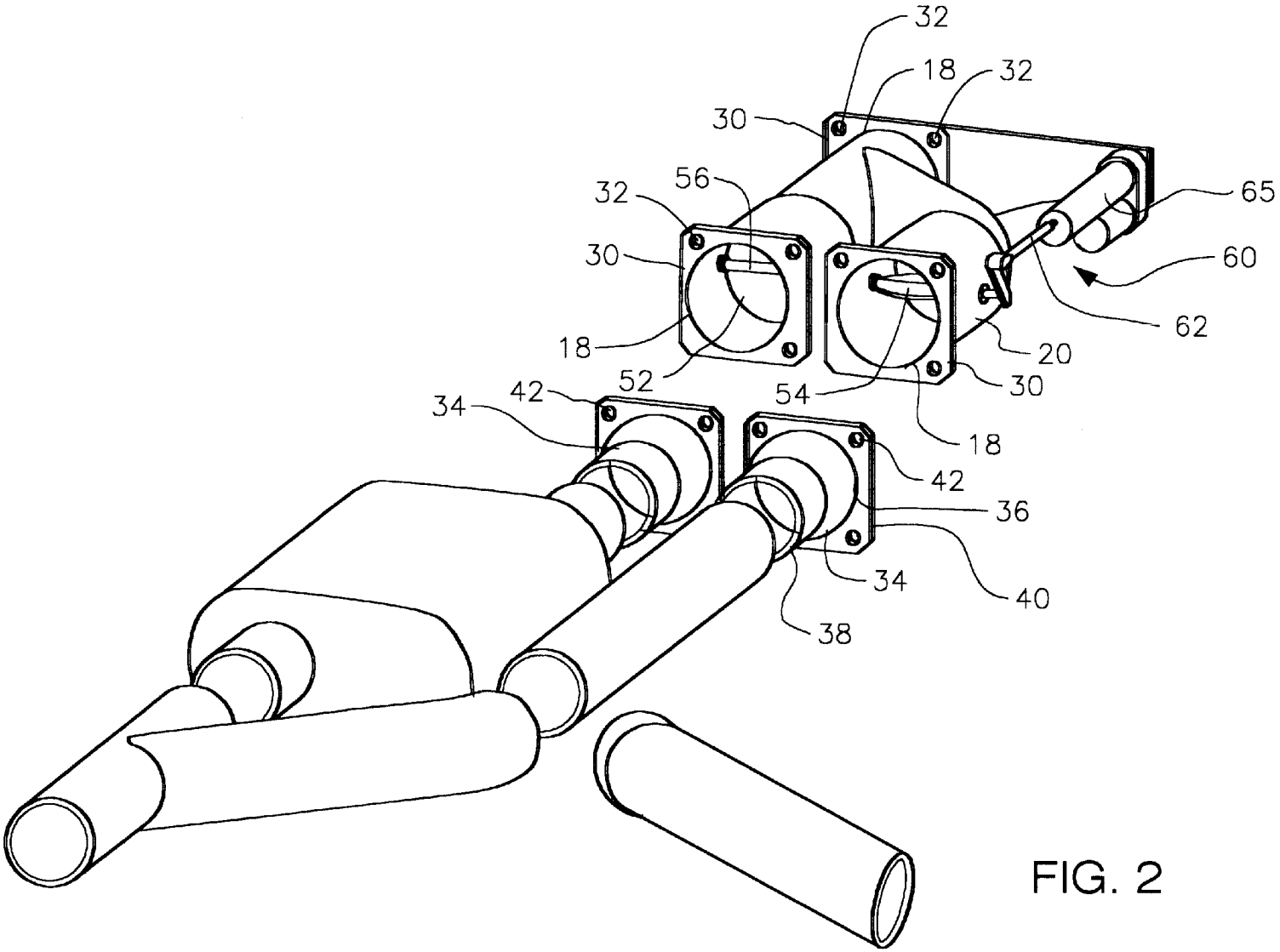
FIG. 2 is a schematic perspective view of the present invention.
Figure 3:
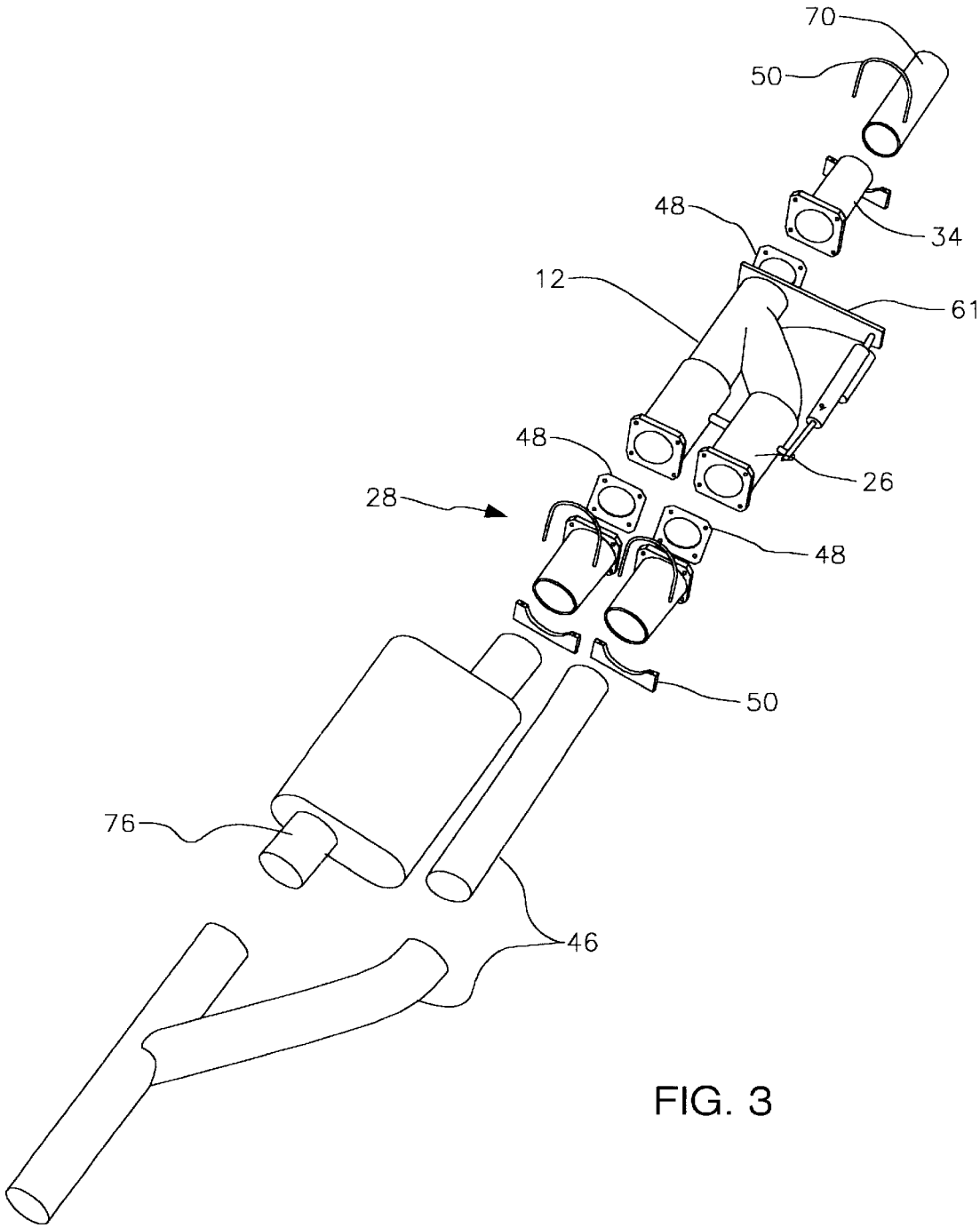
FIG. 3 is a schematic perspective view of the present invention.
Figure 4:
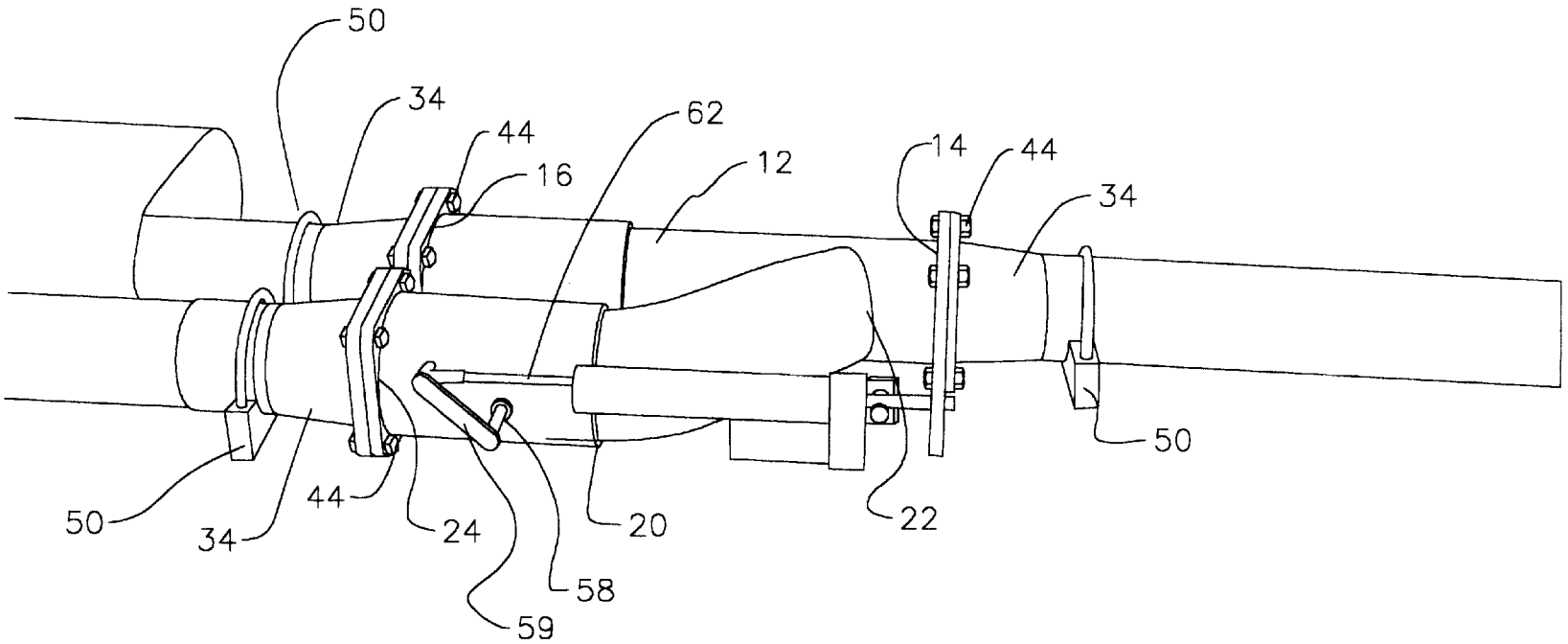
FIG. 4 is a schematic perspective view of the present invention.
Figure 5:
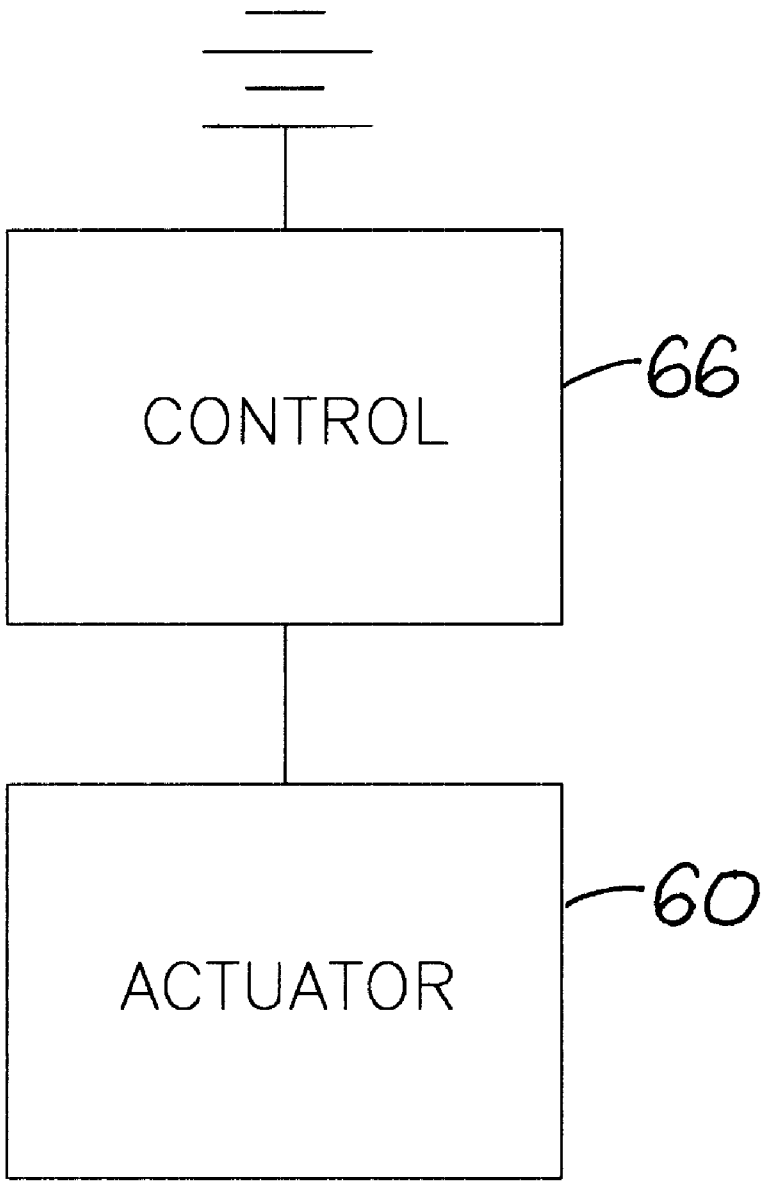
FIG. 5 is a schematic view of the present invention.

With reference now to the drawings, and in particular to FIGS. 1 through 5 thereof, a new exhaust diverter embodying the principles and concepts of the present invention and generally designated by the reference numeral 10 will be described.

As best illustrated in FIGS. 1 through 5, the exhaust diverter 10 generally comprises a device for removably positioning between an exhaust outlet 70 from an engine of a vehicle and an exhaust inlet 72 for a muffler 74.

The device 10 includes a first pipe 12 having a first end 14 and a second end 16. Each of the first 14 and second 16 ends has an edge 18 defining an opening. A second pipe 20 has a first end 22 and a second end 24. The first end 22 of the second pipe 20 is fluidly coupled to the first pipe 12. The second pipe 20 has a bend 26 therein such that the second end 24 of the second pipe 20 extends in generally the same direction as the second end 16 of the first pipe 12. Ideally, the second ends 16, 24 of the pipes 12, 20 are generally co-planar. The second end 24 of the second pipe 20 has an edge 18 defining an opening.

A mounting means 28 mounts the first end 14 of the first pipe 12 to the exhaust outlet 70 and mounts the second end 16 of the first pipe 12 of to the exhaust inlet 72 of the muffler 74. The mounting means 28 includes a plurality of flanges 30. Each of the flanges 30 is attached to and extends around one of the edges 18 of the first 14 and second 16 ends of the first pipe 12 and the second end 24 of the second pipe 20. Each of the flanges 30 has a plurality of apertures 32 extending therethrough.

Each of a plurality of couplers includes a tubular member 34 having a mounting end 36 and a receiving end 38. Each of the mounting ends 36 includes a rim 40 with a plurality of apertures 42 extending therethrough. Each of the apertures 42 on one of the rims 40 is alignable with the apertures 32 on one of the flanges 30 when a respective rim 40 is abutting a respective flange 30. A plurality of fasteners 44 is extendable through the apertures 32, 42 for securing the rims 40 to the flanges 30. The fasteners 44 are preferably a combination of bolts and screws. The receiving ends 38 have a diameter adapted for receiving the exhaust outlet 70 and the exhaust inlet 72.

An exhaust pipe 46 is removably receivable by one of the couplers 34 attached to the second end 24 of the second pipe 20. The exhaust pipe 46 may be a single piece extending away from the second pipe 20 or may be fluidly coupled to an exhaust pipe 76 of the muffler 74. Regardless of which variation is chosen, the purpose is to ensure that exhaust gases are removed to the rear of the vehicle.

Each of a plurality of seals 48 is positionable between an abutting pair of flanges 30 and rims 40. The seals 48 decrease noise of vibration and create a generally airtight seal between the pipes and the couplers.

Each of a plurality of crimping means 50 is provided for crimping the tubular members 34 around the exhaust inlet 72, the exhaust outlet 70 and the exhaust pipe 46. The crimping means 50 allow different diameters of pipes to be joined to the couplers.

A valve system selectively opens and closes passages through the first 12 and second 20 pipes. The valve system includes a first valve 52 positioned in the first pipe 12 and a second valve 54 positioned in the second pipe 20. An actuator 60 is mechanically coupled to the valves 52, 54 for selectively opening and closing the first 52 and second 54 valves such that one of the valves simultaneously opens when the other of the valves closes. The ability of the valves 52, 54 to open and close simultaneously ensures that constant exhaust-gas flow is permitted from said first end 14 of said first pipe 12 through said second ends 16, 24 of said first 12 and second 20 pipes. The first 52 and second 54 valves each ideally comprise a butterfly valve.

The valve system includes a rod 56 extending through and rotatably coupled to the first 12 and second 20 pipes. The rod 56 is orientated generally perpendicular to a longitudinal axis of the first pipe 12. The rod 56 has a free end 58 extending outwardly away from the second pipe 12. Each of the valves 52, 54 is attached to the rod 56. A plane of the first valve 52 is orientated perpendicular to a plane of the second valve 54. A lever 59 is attached to the free end 58 of the rod 56.

A plate 61 is attached to an edge of the flange 18 attached to the first end 14 of the first pipe 12. The plate 61 extends away from flange such that the second pipe 20 is positioned between the second end 24 of the second pipe 20 and the plate 61.

The actuator 60 is attached to the plate 61 and extends between the plate 61 and the lever 59. The actuator 60 includes a piston 62 for selectively rotating the rod 56 in a first direction and a second direction. In this manner, the valves 52, 54 move simultaneously. A hydraulic or pneumatic pump 65 preferably moves the piston 62. Also, a heat shield, not shown, may be attached to the second pipe 20 and positioned between the second pipe 20 and the actuator 60 for protecting the actuator 60 from heat given off by the first 12 and second 20 pipes.

A control 66 is electrically coupled to the actuator 60 for remotely selecting rotation of the rod 56 in the first or second direction. The control 66 is a conventional control for electrically manipulating an actuator 66.

In use, the exhaust outlet 70 is coupled to the first end 14 of the first pipe 12 and the second end 16 of the first pipe 12 is coupled to the exhaust inlet 72. The second end 24 of the second pipe 20 is coupled to the exhaust pipe 46. The control 66 is preferably mounted within the vehicle. The user uses the control 66 to selectively open and close the valves 52, 54 to divert exhaust gases into or away from the muffler 74 to selectively attenuate the audible sounds produced by the engine and to produce greater horsepower and torque by bypassing the muffler 74.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exhaust diverting device for positioning between an exhaust outlet from an engine of a vehicle and an exhaust inlet for a muffler, said device comprising:

a first pipe defining a first passage and having a first end and a second end, each of said first and second ends having an opening;

a second pipe defining a second passage and having a first end and a second end, said first end of said second pipe being mounted to said first pipe such that the second passage is in fluid communication with the first passage, said second end of said second pipe having an opening;

a valve system for selectively opening and closing the respective first and second passages of said first and second pipes, said valve system including:

a first valve positioned in the first passage of said first pipe;

a second valve positioned in the second passage of said second pipe;

a single rod extending through the first and second passages of said first and second pipes, said rod being rotatable with respect to each of said first and second pipes, each of said valves being mounted on said rod such that rotation of said rod causes simultaneous rotation of said first and second valves, said first and second valves being mounted on said rod in a manner such that rotation of said rod in a first direction causes said first valve to be opened and said second valve to be closed and rotation of said rod in a second direction causes said first valve to be closed and said second valve to be opened; and an actuator mechanically coupled to said rod for rotating said rod in said first direction and said second direction; and a plate attached to said first end of said first pipe, said plate lying in a plane oriented substantially perpendicular to a longitudinal axis of said first pipe, said plate extending away from first pipe, said actuator being attached to said plate.

2. The device of claim 1 wherein the plane of said first valve is orientated perpendicular to a plane of said second valve.

3. The device of claim 1 wherein said rod is oriented substantially perpendicular to a longitudinal axis of said first pipe.

4. The exhaust diverting device as in claim 1, said second pipe having a bend therein such that said second end of said second pipe extends substantially parallel to said second end of said first pipe.

5. The device of claim 1 wherein said rod has a free end extending outwardly of one of said pipes, and a lever is attached to said free end of said rod;

wherein said actuator includes a piston attached to said lever for selectively rotating said rod in said first direction and said second direction upon extension and retraction of said piston.

6. The device of claim 5 additionally comprising a control being electrically coupled to said actuator for remotely selecting rotation of said rod in said first direction or said second direction.

7. The device of claim 1 additionally comprising mounting means for mounting said first end of said first pipe to the exhaust outlet and mounting means for mounting said second end of said first pipe to the muffler.

8. The exhaust diverting device as in claim 7, wherein each of said first and second ends of said first pipe and said second end of said second pipe has an edge defining the respective openings, and wherein said mounting means additionally includes a plurality of couplers, each of said couplers including a tubular member having a mounting end and a receiving end, each of said mounting ends being attachable to one of said edges, each of said receiving ends having a diameter adapted for receiving the exhaust outlet, the exhaust inlet and said exhaust pipe.

9. The exhaust diverting device as in claim 8, further including a plurality of crimping means for crimping said tubular members around the exhaust inlet, the exhaust outlet and said exhaust pipe.

10. The exhaust diverting device as in claim 8, wherein each of said mounting ends includes a rim having a plurality of apertures extending therethrough, each of a plurality of flanges being attached to and extending around one of said edges of said first and second ends of said first pipe and said second end of said second pipe, each of said flanges having a plurality of apertures extending therethrough, each of said apertures on one of said rims being alignable with said apertures on one of said flanges when a respective rim is abutting a respective flange, a plurality of fasteners being extendable through said apertures for securing said rims to said flanges, an exhaust pipe being removably receivable by one of said couplers attached to said second end of said second pipe.

11. The exhaust diverting device as in claim 10, further including a plurality of seals, each of said seals being positionable between an abutting pair of flanges and rims.

12. An exhaust diverting device for positioning between an exhaust outlet from an engine of a vehicle and an exhaust inlet for a muffler, said device comprising:

a first pipe having a first end and a second end, each of said first and second ends having an edge defining an opening;

a second pipe having a first end and a second end, said first end of said second pipe being fluidly coupled to said first pipe, said second end of said second pipe having an edge defining an opening;

a mounting means for mounting said first end of said first pipe to said exhaust outlet and for mounting said second end of said first pipe of to said muffler, an exhaust pipe being fluidly coupled to said second end of said second pipe by said mounting means; and a valve system for selectively opening and closing passages through said first and second pipes, said valve system including a first valve positioned in said first pipe and a second valve positioned in said second pipe, an actuator being mechanically coupled to said valves for selectively opening and closing said first and second valves such that one of said valves simultaneously opens when the other of said valves closes, wherein said valve system includes:

a rod extending through and being rotatably coupled to said first and second pipes, said rod being orientated generally perpendicular to a longitudinal axis of said first pipe, said rod having free end extending outwardly away from said second pipe, each of said valves being attached to said rod, a plane of said first valve being orientated perpendicular to a plane of said second valve; and a lever being attached to said free end of said rod;

wherein said actuator includes a piston attached to said lever for selectively rotating said rod in a first direction and a second direction;

a control being electrically coupled to said actuator for remotely selecting rotation of said rod in said first direction or said second direction;

a plate being attached to an edge of said first end of said first pipe, said plate extending away from first pipe such that said second pipe is positioned between said second end of said second pipe and said plate, said actuator being attached to said plate.

13. The exhaust diverting device as in claim 12, said second pipe having a bend therein such that said second end of said second pipe extends in generally the same direction as said second end of said first pipe.

14. The exhaust diverting device as in claim 12, wherein each of said first and second ends of said first pipe and said second end of said second pipe has an edge defining an opening, wherein said mounting means additionally includes:

a plurality of couplers, each of said couplers including a tubular member having a mounting end and a receiving end, each of said mounting ends being attachable to one of said edges, each of said receiving ends having a diameter adapted for receiving the exhaust outlet, the exhaust inlet and said exhaust pipe.

15. The exhaust diverting device as in claim 14, further including a plurality of crimping means for crimping said tubular members around the exhaust inlet, the exhaust outlet and said exhaust pipe.

16. The exhaust diverting device as in claim 14, wherein each of said mounting ends includes a rim having a plurality of apertures extending therethrough, each of a plurality of flanges being attached to and extending around one of said edges of said first and second ends of said first pipe and said second end of said second pipe, each of said flanges having a plurality of apertures extending therethrough, each of said apertures on one of said rims being alignable with said apertures on one of said flanges when a respective rim is abutting a respective flange, a plurality of fasteners being extendable through said apertures for securing said rims to said flanges, an exhaust pipe being removably receivable by one of said couplers attached to said second end of said second pipe.

17. The exhaust diverting device as in claim 16, further including a plurality of seals, each of said seals being positionable between an abutting pair of flanges and rims.

18. An exhaust diverting device for positioning between an exhaust outlet from an engine of a vehicle and an exhaust inlet for a muffler, said device comprising:

a first pipe having a first end and a second end, each of said first and second ends having an edge defining an opening;

a second pipe having a first end and a second end, said first end of said second pipe being fluidly coupled to said first pipe, said second pipe having a bend therein such that said second end of said second pipe extends in generally the same direction as said second end of said first pipe, said second end of said second pipe having an edge defining an opening;

a mounting means for mounting said first end of said first pipe to said exhaust outlet and for mounting said second end of said first pipe of to said muffler, said mounting means including:

a plurality of flanges, each of said flanges being attached to and extending around one of said edges of said first and second ends of said first pipe and said second end of said second pipe, each of said flanges having a plurality of apertures extending therethrough;

a plurality of couplers, each of said couplers including a tubular member having a mounting end and a receiving end, each of said mounting ends including a rim having a plurality of apertures extending therethrough, each of said apertures on one of said rims being alignable with said apertures on one of said flanges when a respective rim is abutting a respective flange, a plurality of fasteners being extendable through said apertures for securing said rims to said flanges, said receiving ends having a diameter adapted for receiving the exhaust outlet and the exhaust inlet, an exhaust pipe being removably receivable by one of said couplers attached to said second end of said second pipe;

a plurality of seals, each of said seals being positionable between an abutting pair of flanges and rims;

a plurality of crimping means for crimping said tubular members around the exhaust inlet, the exhaust outlet and said exhaust pipe;

a valve system for selectively opening and closing passages through said first and second pipes, said valve system including a first valve positioned in said first pipe and a second valve positioned in said second pipe, an actuator being mechanically coupled to said valves for selectively opening and closing said first and second valves such that one of said valves simultaneously opens when the other of said valves closes, said first and second valves comprising butterfly valves, said valve system including:

a rod extending through and being rotatably coupled to said first and second pipes, said rod being orientated generally perpendicular to a longitudinal axis of said first pipe, said rod having free end extending outwardly away from said second pipe, each of said valves being attached to said rod, a plane of said first valve being orientated perpendicular to a plane of said second valve;

a lever being attached to said free end of said rod;

a plate being attached to an edge of said flange attached to said first end of said first pipe, said plate extending away from said flange such that said second pipe is positioned between said second end of said second pipe and said plate;

wherein said actuator is attached to said plate and being attached to said lever, said actuator including a piston for selectively rotating said rod in a first direction and a second direction; and a control being electrically coupled to said actuator for remotely selecting rotation of said rod in said first or second direction.

* * * * *